United States Patent [19]

Fox

[11] Patent Number: 4,862,870

[45] Date of Patent: Sep. 5, 1989

[54] BIMETAL LOCK ARRANGEMENT FOR A SELF-CLEANING OVEN LATCH

[75] Inventor: Joseph S. Fox, Louisville, Ky.

[73] Assignee: General Electric Company, Louisville, Ky.

[21] Appl. No.: 288,076

[22] Filed: Dec. 21, 1988

[51] Int. Cl.[4] ..... F23M 7/00

[52] U.S. Cl. ..... 126/197; 292/DIG. 66; 292/DIG. 69

[58] Field of Search ..... 126/197; 292/DIG. 66, 292/DIG. 69

[56] References Cited

U.S. PATENT DOCUMENTS

| | | | |
|---|---|---|---|
| 3,189,375 | 6/1965 | Getman | 292/113 |
| 3,416,515 | 12/1968 | Mertler | 126/273 |
| 3,438,666 | 4/1969 | Erickson | 292/210 |
| 3,540,767 | 11/1970 | Siegel | 292/210 |
| 3,625,197 | 12/1971 | Pirker et al. | 126/273 R |
| 3,638,638 | 2/1972 | Phifer | 126/197 |
| 3,776,216 | 12/1973 | Pirker et al. | 126/197 |
| 3,831,580 | 8/1974 | McLean | 126/197 |
| 4,133,337 | 1/1979 | Shea | 126/197 |
| 4,351,288 | 9/1982 | Gasloli | 126/197 |

*Primary Examiner*—Carroll B. Dority, Jr.

*Attorney, Agent, or Firm*—H. Neil Houser; Radford M. Reams

[57] ABSTRACT

A self-cleaning over door latching mechanism is provided with a locking arrangement responsive to the oven cavity temperature, which includes a locking pin moved by a snap action bimetal member mounted in thermal communication with an oven cavity wall. The bimetal member moves the locking pin to a locking position when the temperature sensed by the bimetal rises above the locking temperature. In its locked position the locking pin prevents the opening of the latch until the temperature in the oven cavity falls below the locking temperature. In its locked position the locking pin also actuates a lock switch electrically connected in parallel with a thermal limit switch. The thermal limit switch provides over temperature protection for the cavity when operating in the normal cooking modes. When actuated, the lock switch shunts the limit switch thereby enabling the temperature in the cavity to rise to the self-clean range. If the locking pin fails to move to its locked position, the limit switch limits the temperature in the cavity to a level at which the door may be safely opened.

8 Claims, 4 Drawing Sheets

BIMETAL LOCK ARRANGEMENT FOR A SELF-CLEANING OVEN LATCH

BACKGROUND OF THE INVENTION

This invention relates to an improved locking arrangement for the oven latch mechanism in a domestic cooking appliance equipped with a self-cleaning oven. Such ovens have in addition to the normal cooking functions or modes, a self-clean mode in which the temperature is raised to a maximum temperature in the 750°-950° F. range to remove the food soil and grease spatter that accumulates on the wall of the oven liner by pyrolysis. In such high temperature ovens, it is of primary importance to latch the oven door before the cleaning cycle begins and to insure that the door cannot be opened during the period when the temperature is elevated to the self-clean temperature range.

In view of the convenience of automatic self-cleaning such ovens have become quite popular and a variety of arrangements have been proposed to perform the latching and locking functions.

One approach involves a relatively complex and costly mechanical locking structure equipped with a solenoid actuated locking mechanism controlled by a sequence timer. An example of such an arrangement is described in commonly assigned Re. 26,943 to Barber. The sequence timer is energized by selection of the self-clean cycle and latching of the door. An initial ten minute Wait period is provided during which the latch may be opened. The Wait period is followed by a 90 minute clean cycle, during which a solenoid controlled plunger prevents opening of the latch. The clean cycle is followed by a twenty minute Cool period. During this period the heating means is de-energized but the plunger continues to prevent opening the latch. At the conclusion of the Cool period the timer energizes the solenoid to move the plunger from its locking position permitting the opening of the latch. Another example of a solenoid actuated locking mechanism for a self-cleaning oven latch can be found in U.S. Pat. No. 3,831,580 to McClean.

Such an arrangement performs quite satisfactorily. However, it is mechanically and electrically relatively complex involving a solenoid and a number of relays and switches. In addition, since it is strictly timer controlled, it may result in the oven latch remaining locked longer than necessary particularly in those instances when the user elects to halt a self-cleaning operation prematurely.

A number of latching and locking arrangements using bimetal devices responsive to oven temperature in combination with the door latch mechanism are also known in the art. U.S. Pat. No. 3,416,515 to Mertler describes an automatic latching arrangement in which a snap action bimetal element responsive to the oven temperature automatically latches the oven door when the oven temperature exceeds the bimetal trip point. In this arrangement the bimetal is linked to the latch arm by a plunger. The snap-action movement of the bimetal to its latching position causes the plunger to move the latch arm into latching engagement with the door. The plunger also trips a switch operative to actuate an indicator lamp to indicate that the door is locked for self-cleaning. The disclosure also notes that the switch could also be used for some unspecified interlock or other control functions. No means is provided for the user to manually latch or unlatch the oven.

U.S. Pat. No. 3,438,666 to Erickson discloses a locking arrangement for a manually operable latching mechanism in which a blocking member is rotated into blocking relation with the door latch mechanism by the expansion of a bimetal coil to prevent opening of the latch when the oven temperature is above a predetermined value. In its latched position the latch actuates a switch which conditions the control circuit for operation only when the door is closed and latched. Additional examples of the use of a bimetal coil to rotate a blocking member into blocking relationship with the latch can be found in U.S. Pat. Nos. 3,540,767 to Siegel and 4,133,337 to Shea.

U.S. Pat. No. 3,638,638 discloses a latching and locking arrangement for a self-cleaning oven which employs a combination of two bimetal members in a pivoted lever configuration to move the free end of the lever assembly into locking position to prevent opening of the latch. The second bimetal, having negative deflection characteristics below a certain temperature, cooperates with the main bimetal to aid in movement of the locking means into locking position as the oven temperature rises and out of locking position as the temperature falls at the beginning and end of a self-clean cycle respectively. The bimetals are arranged to reduce the temperature differential at which locking and unlocking would occur using a single pivoted lever bimetal arrangement.

The foregoing latching arrangements involving coiled bimetal devices or multiple bimetal elements involve relatively complex bimetal structures which respond gradually to temperature changes. In addition, no provision is made for preventing operation in the self-clean temperature range in the event the bimetal fails to move to the locking position.

It is therefore an object of the present invention to provide a relatively simple inexpensive locking arrangement for a self-cleaning latch mechanism which is manually operable by the user and which provides snap action movement between the locking and unlocking position for positive locking action at the predetermined trip temperature.

It is a further object of the present invention to provide a locking arrangement of the aforementioned type which includes fail safe means for positively detecting locking movement of the locking means and prevents operation of the oven in the self-clean temperature range if the locking member fails to move to its locking position.

SUMMARY OF THE INVENTION

A self-cleaning oven door latching arrangement is provided with locking means responsive to the oven cavity temperature to lock the door latch in its closed or latched position when the temperature in the cavity rises above a predetermined locking temperature, comprising a locking pin reciprocably movable between a locked position and an unlocked position, operatively coupled with a snap action bimetal member mounted in thermal communication with an oven cavity wall. The bimetal member moves the locking pin to its locking position when the temperature sensed by the bimetal rises above the locking temperature. The locking pin in its locked position blocks the return path of a latch tail extending from the latch handle portion of the latch mechanism thereby preventing the opening of the latch until the temperature in the oven cavity falls below the locking temperature.

In accordance with one aspect of the invention fail safe means is provided to positively detect locking of the latch and prevent the heating of the cavity above a temperature at which the door can be safely opened unless the latch is actually locked. In a preferred form of the invention the fail safe means comprises a lock switch mechanically actuated by and de-actuated by movement of the locking pin in and out of its locked position respectively. The lock switch is electrically connected in parallel with a thermal limit switch. When the lock switch is de-actuated, the thermal limit switch provides over temperature protection for the cavity when operating in the normal cooking modes, by de-energizing the heating means when the temperature in the cavity rises above the normal cooking temperature range. The trip point for the limit switch is set at a level which causes it to trip after the bimetal but at a temperature at which the door may be safely opened. When actuated, the lock switch shunts the limit switch thereby enabling the temperature in the cavity to rise to the self-clean range.

BRIEF DESCRIPTION

Figure 1:
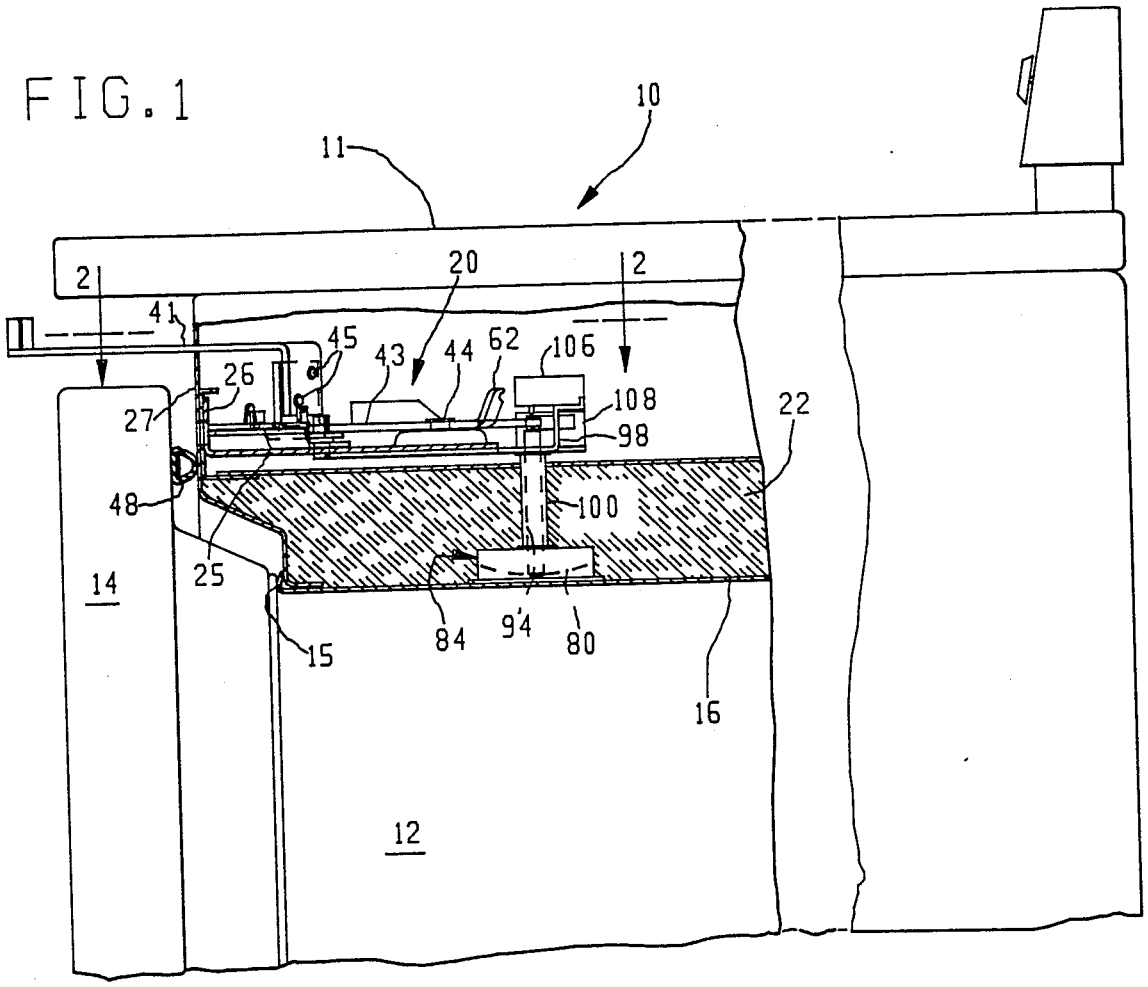
FIG. 1 is a partial right side elevational view of a free-standing electric range with some parts broken away and some in cross section to show the main elements of the latch mechanism embodying the improvement of the present invention.

Turning now to a consideration of the drawings and in particular to FIG. 1, there is shown for illustrative purposes the upper portion of a free-standing electric range 10 having a top surface 11, an oven cavity 12, and a front opening oven door 14 which closes front facing oven cavity opening 15. The oven cavity 12 includes two standard electric heating elements (not shown) a lower bake unit arranged just above the bottom of the cavity 12 and an upper broil unit located just beneath the top wall 16 of cavity 12.

Figure 6:
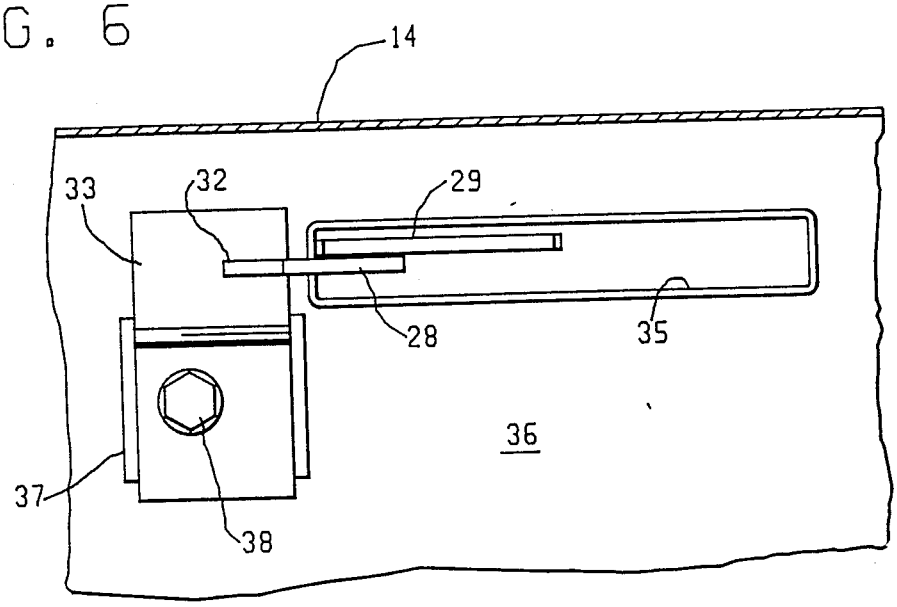
FIG. 6 is a fragmentary plan view of the inner door panel taken along lines 6—6 of FIG. 4 illustrating the keeper portion of the latch mechanism with the latch in its latched position.
Figure 4:
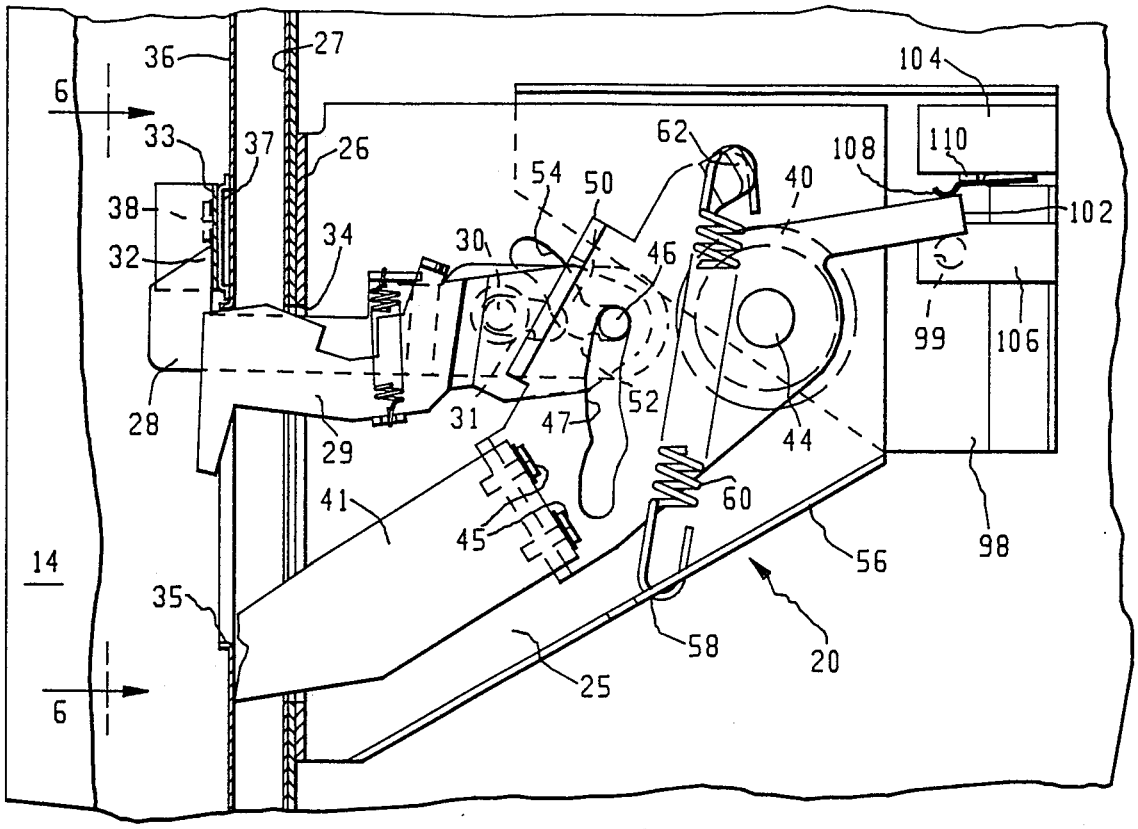
FIG. 4 is a fragmentary plan view similar to that of FIG. 2 illustrating the latch mechanism in its closed and locked position.
Figure 5:
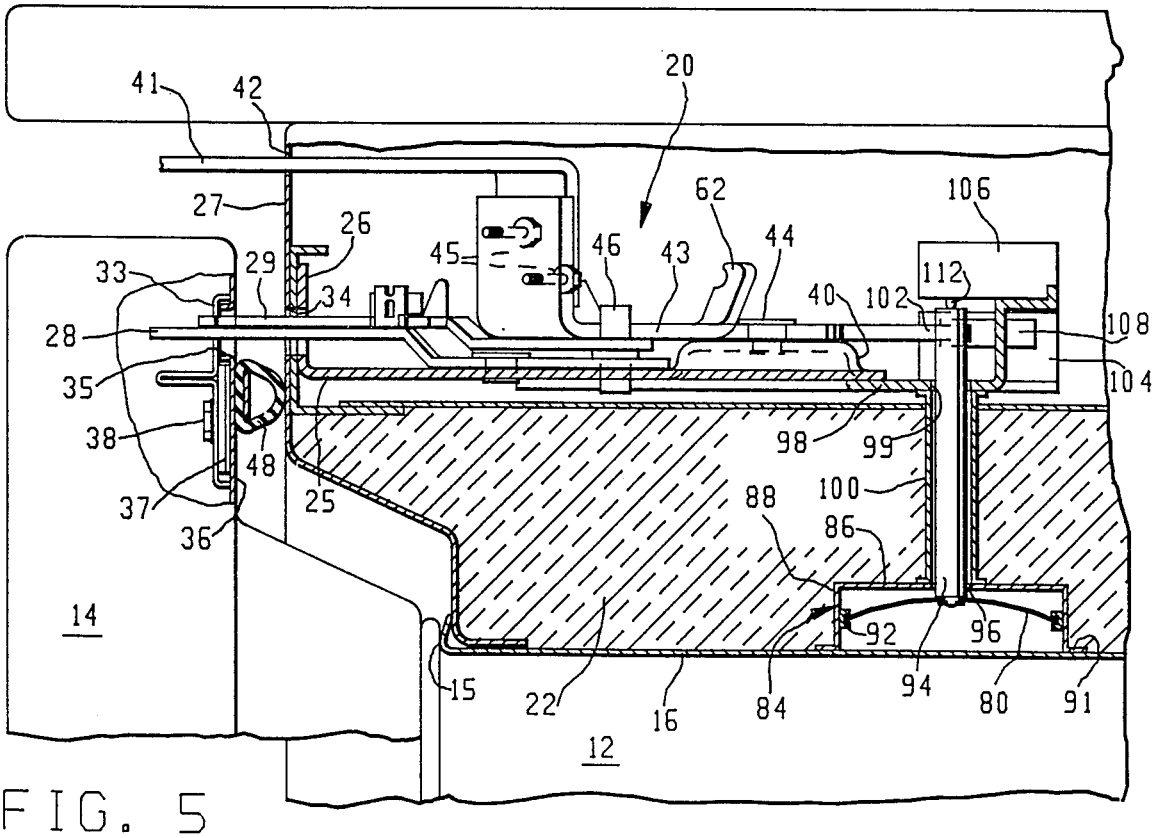
FIG. 5 is a fragmentary elevational view similar to FIG. 3 illustrating the latch mechanism in its closed and locked position.

A door latch mechanism indicated generally by numeral 20 is located within the upper front portion of the range cabinet above a layer of insulation material 22 which surrounds cavity 12. As best seen in FIGS. 2–5, latch 20 comprises a mounting bracket 25, which is a generally flat sheet metal member with an upturned flange 26 along its front edge so that it may be screwed to the rear surface of range cabinet front wall 27. A vertically pivoted latching bolt 28, which is partially obscured in FIGS. 2 and 4 because it is carrying a door sensing bar 29, is pivotally mounted on mounting bracket 25 to swing in a horizontal plane between its open position (FIG. 2) and its closed position (FIG. 4) by a pin and slot connection comprising fixed pin 30 on bracket 25 and the elongated slot 31 in latching bolt 28. The forward end of latching bolt 28 has a hook portion 32 which is adapted to engage a keeper 33 mounted on oven door 14. The front wall of the range body has an elongated horizontal slot 34 for receiving the latching bolt 28 therethrough and oven door 14 has a related slot 35 formed in its inner door wall 36. As best seen in FIGS. 4–6, the door is hollow in the vicinity of this slot to permit the hook portion 32 of latching bolt 28 to extend through slots 34 and 35 into the interior of door 14 to engage keeper 33 at the side edge of the slot 35. Keeper 33 is a sheet metal part suitably secured to bracket member 37 such as by screws 38. Bracket 37 is in turn suitably secured to inner door wall 36 such as by tack welding.

The rearward portion of mounting bracket 25 has formed therein a raised portion 40 to pivotally support the latch handle which is formed in two parts, a lever member 41 which extends outwardly through horizontal slot 42 in range cabinet front wall 27 for user manipulation and a base member 43 which is pivotally mounted to bracket 25 at embossment 40 by pivot pin 44 fixed to bracket 25. Lever member 41 and base member 43 are joined by machine screws 45. The latch handle pivots in a horizontal plane through an angle of about 60° from the open position (FIG. 2) to the fully closed position (FIG. 4).

Figure 2:
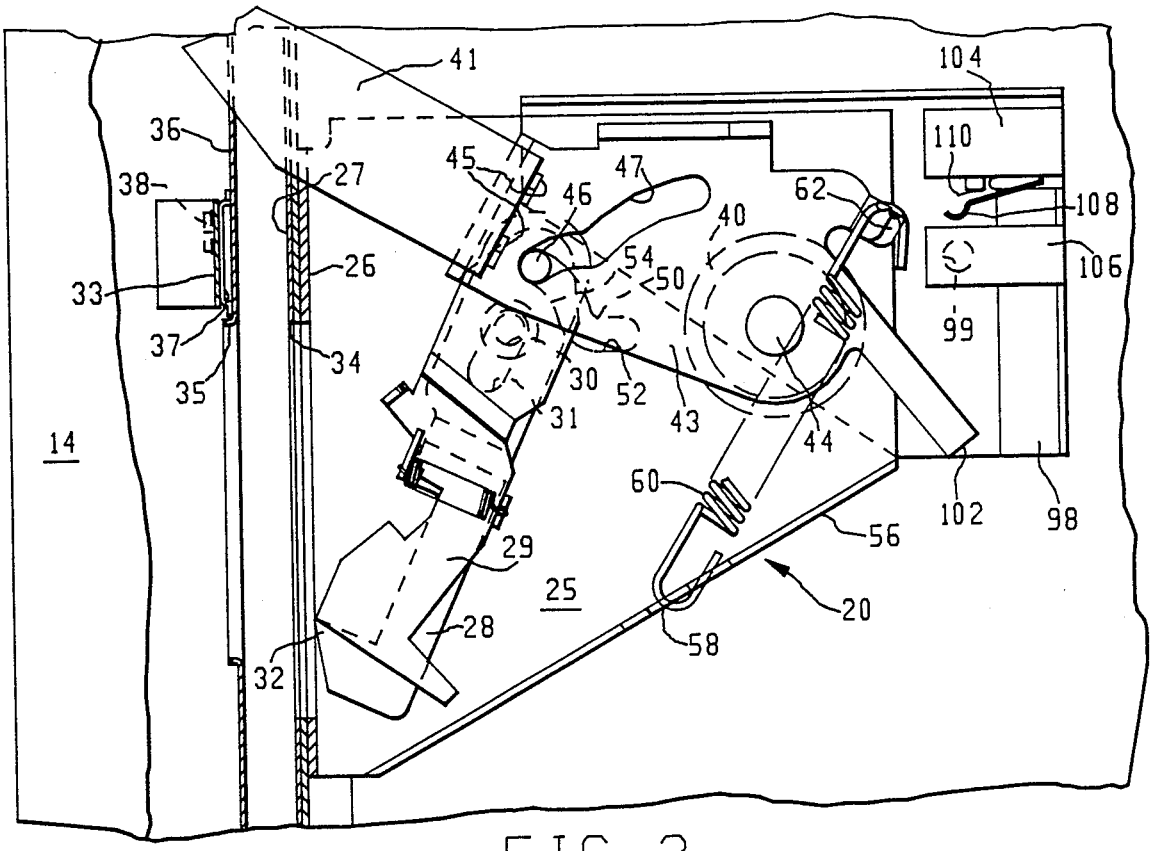
FIG. 2 is a fragmentary plan view partly in cross section on an enlarged scale taken along lines 2—2 of FIG. 1 and showing the latch mechanism in its open position.

Base member 43 is pivotally connected to latching bolt 28 by a pin and slot connection in the form of vertical pin 46 carried by latching bolt 28 that is captured within a cam-shaped slot 47 formed in base member 43. Cam slot 47 is shaped to pivot latching bolt 28 in a counterclockwise direction as seen in FIG. 2 when the latch mechanism is being opened and in a clockwise direction when the mechanism is being closed. Cam slot 47 further serves to pull latching bolt 28 in a rearward direction away from the door once the latching bolt has engaged the keeper, so as to clamp the door tightly against door gasket 48.

The proper turning action of latching bolt 28 is also controlled by a second cam slot 50 formed in bracket 25. Slot 50 is of generally sock shape with a substantially straight ankle portion 52 and a curved front portion 54. The curved front portion 54 of slot 50 causes the latching bolt to pivot from its unlocked retracted position to its fully extended position while the straight portion 52 permits cam slot 47 of handle lever member 41 to withdraw latching bolt 28 slightly into the range body tightly clamping the door in the closed position. Pin 46 has an upper end cooperating with slot 47 and a lower end beneath latching bolt 28 cooperating with slot 50 in mounting bracket 25.

Bracket 25 further includes an upwardly extending flange 56 along one side thereof notched at 58 to receive one end of tension spring 60. The other end of spring 60 attaches to tab 62 extending upwardly from handle base 43. Spring 60 functions in over center spring fashion relative to pivot pin 44 to bias the latch handle in its fully open and fully closed positions. As thus far described, the latch mechanism is generally conventional and substantially similar to that disclosed in U.S. Pat. No. 3,189,375.

As briefly mentioned in the Background discussion, when the oven is operating in the self-clean mode, the temperature in the oven cavity is typically on the order of 750°-950° F. In addition to requiring that the door be latched when operating in the self-clean mode, provision must also be made to prevent the unlatching of the oven door when such temperatures exist in the cavity.

In accordance with the improvement of the present invention a locking arrangement is provided which comprises a bimetal device responsive to the temperature in the oven, operative to lock the latch mechanism in its closed position when the temperature sensed by the bimetal exceeds a predetermined value between the normal cooking temperature range and the self-cleaning temperature range.

Figure 3:
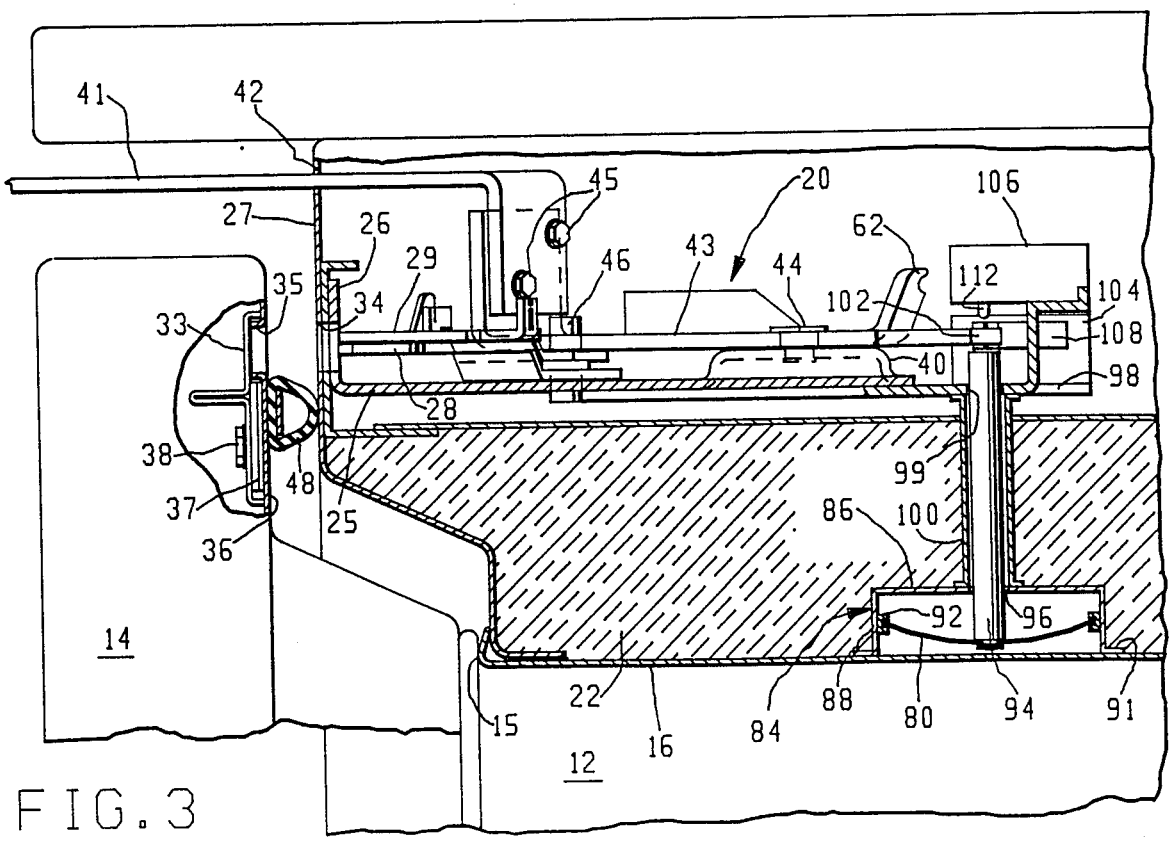
FIG. 3 is a fragmentary elevational view of the oven of FIG. 1 on an enlarged scale showing the latch mechanism in its open position.

As best seen in FIGS. 3 and 5, the locking structure comprises a bimetal member 80 in the form of a snap action disc, disposed in close proximity to and in thermal communication with the top wall 16 of oven cavity 12 so as to be responsive to the temperature in cavity 12. Bimetal member 80 is enclosed in an inverted generally cup-shaped housing 84 mounted on top wall 16 of oven cavity 12 having a top wall 86 and side wall 88, with a peripheral flange 91 at the base of side wall 88 for suitable attachment to the top wall 16 of oven cavity 12 such as by spot welding.

Bimetallic disk 80 is suitably retained in housing 84 such as by a peripheral mounting ring 92 which may be spot welded to the inner face of housing side wall 88. The outer rim of disk 80 acts against the housing side wall 88. The central portion of the disk is adapted to move vertically in response to temperature changes. Locking pin 94 has one end attached loosely but positively to the central area of bimetallic disk 80. This may be accomplished by having one end of the locking pin 94 pass through an aperture in the bimetallic disk and then having this end spun over to positively connect the locking pin to the disk. Top wall 86 of housing 84 has a central aperture 96 which receives the locking pin. A lock support bracket 98 is mounted to bracket 25 as a rearward extension of the bracket to support additional locking structure and associated switches. An aperture 99 is formed in bracket 98 in vertical alignment with aperture 96 in top wall 86 of housing 84. A cylindrical sleeve 100 extends between top wall 86 of housing 84 and lock support bracket 98 to guide the vertical movement of locking pin 94. Sleeve 100 is suitably secured at one end to top wall 86 of housing 84 and at other end to lock support member 98 and axially aligned with apertures 96 and 99.

Bimetallic disk 80 will snap from between its lowermost position shown in FIG. 3 to its uppermost position shown in FIG. 5 in response to changes in temperature in the housing which temperature relatively closely tracks the temperature in the oven cavity proximate the housing. The snap movement of the disk moves the locking pin between its unlocked position (FIG. 3) and its locked position (FIG. 5). A latch tail 102 comprising a rigid extension of latch handle base member 43 of latch mechanism 20 provides the mechanical link between the latch mechanism and the locking mechanism. Tail 102 extends rearwardly from base member 43 in a direction substantially opposite handle lever member 41 and pivots in concert therewith.

In the locked position (FIG. 5), the free end of locking pin 94 extends behind latch tail 102, blocking the return path of latch tail 102 from its closed position to its open position thereby locking the latch mechanism in its closed position. By this locking arrangement the locking pin 94 locks the latch mechanism in its closed position when the temperature sensed by disk 80 exceeds the bimetal trip point temperature and keeps it locked until the sensed temperature drops below the trip point temperature. By proper selection of the trip point temperature the oven door cannot be opened unless the temperature in the cavity is within an acceptable range. The particular value chosen for the bimetal trip point must be high enough that the bimetal device does not unnecessarily respond to oven temperatures which occur during normal cooking operations and low enough to lock the latch before the temperature in the cavity reaches a level at which it becomes hazardous to open the oven door.

Two switch means, a latch switch 104 and a lock switch 106, cooperate with the door latching and locking mechanisms to prevent the temperature in the oven cavity from rising to the self-clean temperature range unless the door is closed and the latch is actually locked in its closed position. Specifically, latch switch 104 prevents full energization of the heating circuit for the clean mode unless the door is latched, i.e. the latch is in its closed position; and lock switch 106 cooperates with a thermal limit switch to perform a fail safe function. As will be hereinafter described in greater detail with respect to FIG. 7, the lock switch is operative when actuated, to shunt the thermal limit switch thereby enabling the temperature in the cavity to increase into the self-clean temperature range.

Latch switch 104 is a microswitch mounted to lock bracket 98. Latch switch 104 is positioned rearwardly of pivot pin 44 with actuator arm 108 of switch 104 extending proximate actuator button 110 and arranged for movement in the plane of rotation of latch tail extension 102. As best seen in FIG. 4, latch switch 104 is positioned such that latch tail 102 presses actuator arm 108 into actuating engagement with button 110 of switch 104 when the handle member is in the closed position. As will be hereinafter described in greater detail with reference to FIG. 7, latch switch 104 is operative when actuated to enable the full heat cleaning circuit for the oven so that it is only possible to raise the oven temperature up to the heat cleaning temperature range of between 750°-950° F. when the latch mechanism is in its fully closed position. As hereinbefore described, the door sensing bar prevents the latch from closing unless the door is closed. Consequently, the combination of door sensing bar and latch switch cooperate to insure that the oven is not heated to the self-clean range unless the door is closed and latched.

The lock mechanism cooperates with lock switch 106 which provides fail safe protection against a failure of the locking mechanism by cooperating with the temperature limit switch to prevent operation of the oven in the self clean temperature range in the event locking pin 94 fails to move to its locked position. Lock switch 106 is a double pole microswitch mounted to lock support bracket 98 with its actuator button 112 aligned over aperture 99 for actuating engagement with the free end of locking pin 94 when in its locked position. As will be hereinafter described in greater detail with respect to the circuit diagram of FIG. 7, lock switch 106 is operative when actuated to allow the temperature in the cavity to reach the self-clean range by effectively shunting a thermal limit switch whose function is to limit the temperature in the cavity to a temperature less than the self-clean range.

Figure 7:
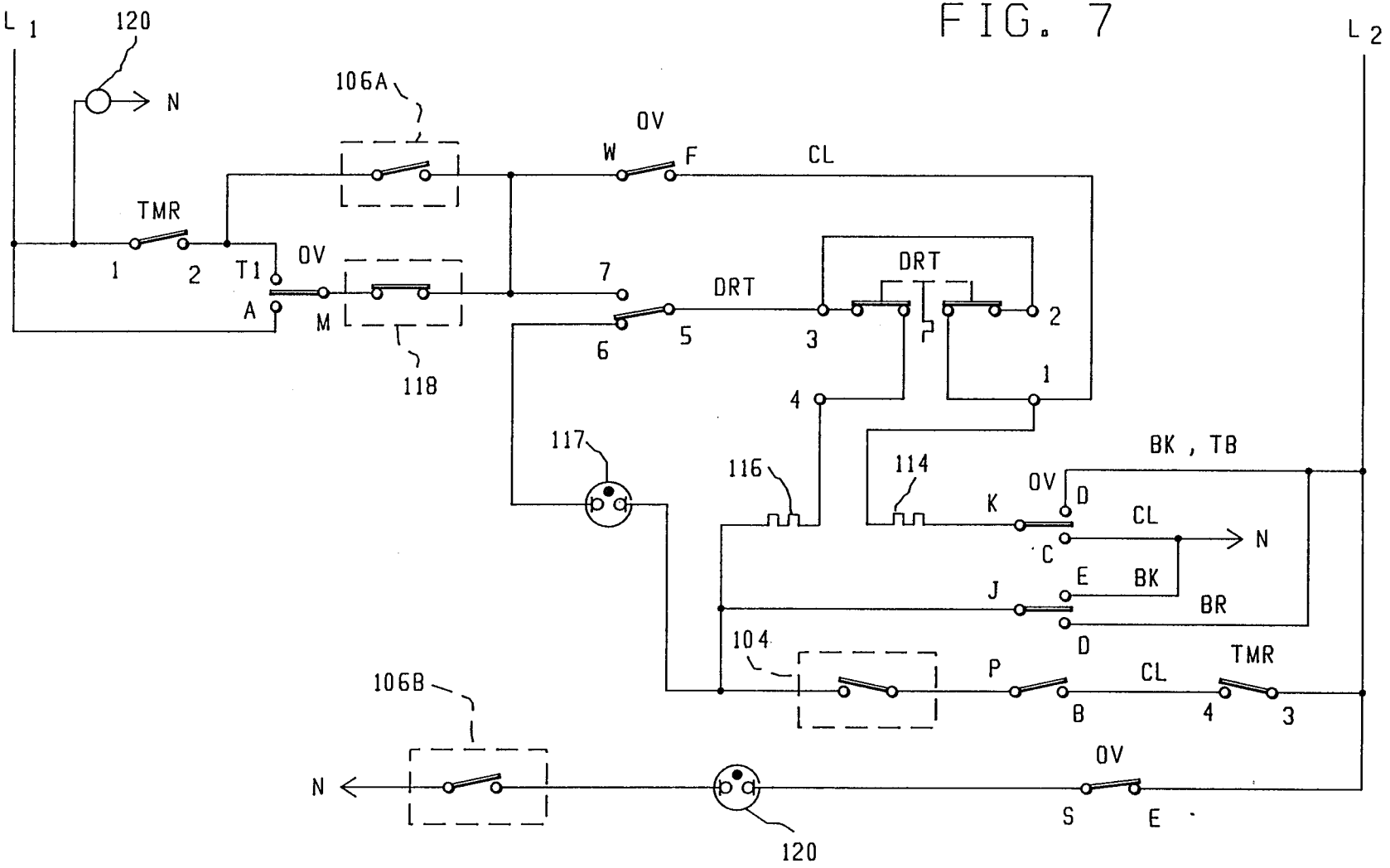
FIG. 7 is a simplified schematic diagram for the power control circuit for the heating system of the oven in FIG. 1.

Turning now to a consideration of the power control circuit for the oven of range 10 with particular reference to the schematic circuit of FIG. 7, range 10 is adapted for energization by a standard 3 wire 240 volt 60 Hz domestic power supply. This power supply has a pair of power lines designated L1 and L2 with a voltage of 240 volts therebetween and a grounded neutral conductor N with 120 volts across L1 or L2 and N. The heating means comprises two heating elements, bake element 114 and broil element 116. Contacts A, B, C, D, E, F, K, J, M, P, S, T, and W are all part of a user actuable oven control switch (OV) which serves to make and break the circuit and set-up the various circuit combinations available for the normal cooking operation, such as Bake, Time-Bake, and Broil as well as for setting up the high temperature heat cleaning cycles.

These controls are also labelled with the particular operation(s) that is involved when the contacts are closed. For example, during a baking operation (BK) contact combinations AM and JE are closed. During broiling (BR) AM and JD are closed; during time bake (TB) TIM and KD are closed; and during clean (CL), contacts TIM, KC and PB are closed.

A dual range thermostat control (DRT) cycles contacts 1–7 in accordance with the user selected Baking temperature setting or the Broil setting or the Clean setting. A temperature limit switch 118 when in the circuit prevents the temperature in the cavity from substantially exceeding the maximum temperature likely to occur under normal cooking operations from reaching the self-cleaning level; and finally contacts TMR1–TMR4 are contacts for cam-actuated timer switches driven by timer motor 120 connected between L1 and N.

The baking circuit has bake element 114 connected across L1 and L2 and broil element 116 connected across L1 and N. The circuit may be traced from L2 through OV contacts KD, to the bake element 114 and the dual range thermostat (DRT) contacts 1,2 and 5,7, temperature limiter contacts 118 and OV contacts AM to L1. At the same time the broil unit 116 is connected to N through OV contacts JE and to L1 through DRT contacts 3,4 and on to L1 as described for the bake unit.

The broiling circuit has the broil element 116 as the only element energized and it is connected across L1 and L2. This circuit is from L2 through OV contacts JD, DRT contacts 3,4 and 5,7, temperature limiter contacts 118 and OV contacts AM to L1.

The time baking circuit is the same as the baking circuit except that OV contact M is connected to TI rather than A to switch timer switch (TMR) contacts 1,2 into the circuit. Timer contacts 1,2 are broken to disconnect both heating units from L1 when the selected bake time expires.

In order for the heating means to provide sufficient wattage to raise the temperature in the cavity to the self-clean temperature range (nominally 750°–950° F.) the broil unit is operated at full power (220 volts) and the bake unit is operated at ¼ power (110 volts). To this end, the self-clean circuit comprises broil unit 116, connected across L1 and L2, and bake unit 114 connected between L1 and N. One side of the bake unit is connected to N through OV contacts KC and one side of the broil unit 116 is connected to L2 through OV contacts PB, TMR contacts 3,4 and the latch switch 104. By this arrangement latch switch 104 is operative when actuated to enable energization of the broil element, thereby enabling full energization of the self-clean circuit. The other side of bake element 114 is connected to the other side of broil element 116 through DRT contacts 2,3 which are shunted together. Both elements are then connected to L1 through DRT contacts 1,2, OV contacts WF, lock switch contacts 106A and TMR contacts 1,2. The clean circuit also includes an indicator light 117 connected between DRT contact 6 and one side of latch switch 104. Light 117 is energized to signify to the user that the self-clean mode is in progress.

As hereinbefore described, latch switch 104 is actuated by latch tail 102 when the latch lever handle 41 is moved to its closed position. The closing of latch switch 104 thereby enables energization of the broil element 116 when the selector switch (OV) is set for clean mode operation (CL).

By this arrangement latch switch 104 is operative to prevent energization of the broil element in the self-clean mode when open, thereby preventing full energization of the self-clean circuit when the latch is unlatched, and operative to enable energization of the broil unit when actuated, thereby enabling full energization of the self-clean circuit when the latch handle 41 is in its closed position.

Lock switch 106 in its preferred form is a double pole switch having contacts 106A connected in shunt with temperature limiter 118 and in series between TMR contacts 1,2 and OV contacts WF. By this arrangement when lock switch contacts 106A are open, the temperature limiter 118 is operative to disconnect L1 if the temperature in the cavity exceeds the limiter set point which is less than the self-cleaning range. With lock switch contacts 106A closed, limiter 118 is bypassed permitting the cavity temperature to be controlled by the dual range thermostat (DRT) which in the clean mode maintains the self-clean temperature range typically in the 750°–950° F. range. This provides a safeguard against operation of the oven in the self clean temperature range unless the door is properly locked. If for whatever reason the locking pin should fail to move to its locking position, contacts 106A would remain open. Limit switch 118 would then cycle to prevent the oven temperature from exceeding the trip point temperature for the limit switch which is sufficiently low that it would not be hazardous to open the oven.

The second pair of lock switch contacts 106B controls energization of signal light 120 to which provides a visual signal to the user regarding the state of the latch. When operating in the clean mode one side of light 120 is connected to N through selector switch contacts SE and the other side is connected to L2 through lock switch contacts 106B. Thus, the light is energized when bimetal 80 has moved locking pin 94 to its locked position thereby locking the latch and actuating switch 106.

Use of the latching and locking mechanism to facilitate operation in the self-clean mode will now be described. To initiate operation in the self-clean mode the user closes the oven door and moves latch handle 41 from its open position (FIG. 2) to its closed position (FIG. 4) by horizontal movement from left to right when facing the oven. The over center action of spring 60 will strongly urge the handle toward its closed position as the handle approaches that position. The door is now securely latched and the latch switch 104 is actuated by latch tail 102 to close latch switch contacts 104 (FIG. 7), enabling full energization of the self-clean circuit by enabling energization of both the bake element and the broil element.

Selection of the clean mode by proper manipulation of the oven selector switch closes the OV switch contacts for the self-clean circuit and the oven begins to heat. Locking pin 94 remains in its unlocked position (FIG. 3) until the oven temperature rises to approximately 600° F. at which time bimetal member 80 snaps to its uppermost position thereby moving locking pin 94 to its lock position (FIG. 5). In this position locking pin 94 actuates switch 106 thereby closing contacts 106A and 106B (FIG. 7). With pin 94 in its locked position blocking the path of latch tail 102, the latch cannot be moved to its open position. Light 120 is energized via contacts 106A signifying to the user that the door is now locked.

When the temperature rises above 650° F., limit switch 118 opens. Had locking pin 94 for some reason failed to move to its locked position, the opening of the limit switch would remove L1 from the circuit thereby de-energizing the bake element and thus preventing the temperature in the cavity from reaching the self-clean temperature range. When operating properly, locking pin 94 closes contacts 106B thereby shunting limit switch 118 and enabling energization of the full self-clean circuit under the control of the dual range thermostat (DRT).

The duration of the self-clean cycle is controlled by the timer 120. On termination timer contacts TMR 1,2 and 3,4 open to de-energize both heating elements. However, the cavity temperature will remain high for some time thereafter. Locking pin 94 will remain in its locking position until the temperature of the cavity causes the temperature sensed by bimetal member 80 to drop below approximately 600° F. at which point bimetal member 80 will snap back to its lowermost position retracting locking pin 94 out of the return path of latch tail 102 thereby permitting the latch handle to be moved to its open position. The retraction of locking pin 94 also deactuates lock switch 106 thereby de-energizing lock light 120 which remains energized until the locking pin returns to its unlocked position.

In the illustrative embodiment the bimetal and limit switch trip point parameters are selected to cause the bimetal to snap to its uppermost locking position when the temperature in the oven rises above approximately 600° F. and the limit switch to trip open at an oven temperature of approximately 650° F. These values are intended to be illustrative and not limiting. The critical factors in selecting these parameters are that the bimetal trip point must be low enough to snap the disk to its uppermost position before the limit switch opens, and the limit switch must trip open at a level at which the oven door can be opened safely.

As is apparent from the foregoing the present invention as illustratively embodied herein provides an improved latching and locking mechanism for a self-cleaning oven which locks and unlocks the latching mechanism as a function of the temperature in the oven cavity. In its preferred form, the locking arrangement includes failsafe means, which positively detects movement of the locking mechanism to its locking position and which prevents the temperature in the cavity from exceeding a temperature at which the oven door can be safely opened unless the locking mechanism has properly moved to its locking position.

While in accordance with the Patent Statutes, a specific embodiment of the present invention has been illustrated and described herein, it is realized that numerous modifications and changes may occur to those skilled in the art. It is therefore to be understood that the appended claims are intended to cover all such modifications and changes as fall within the true spirit and scope of the invention.

What is claimed is:

1. In a domestic self-cleaning oven having a heated oven cavity, an access door for closing and sealing the cavity, and heating means arranged for connection to an energy source for heating the cavity, said heating means controlled by a user adjustable thermostat for normal cooking operations between about 150° F. and 550° F. and for heat cleaning operation at greater than 750° F. for removing food soils from the cavity walls and a thermal limit switch operative to prevent the temperature from substantially exceeding said normal cooking range, and a door latching mechanism comprising a latching bolt having a hook portion on the free end thereof, the door including keeper for mating engagement with the hook portion of the latching bolt, and a pivotally mounted handle lever pivotally connected to the latching bolt so that swing action of the handle lever from its open to its closed position causes a swinging movement in the bolt into mating engagement with the keeper, the improvement comprising:

a latch tail rigidly coupled to said latching handle for swinging movement in concert therewith;

a latch switch actuated by said latch tail when said handle is in its closed position, said latch switch being operative when actuated to enable energization of the heating means for operation in the self-cleaning mode;

a locking pin movable between a locked position and an unlocked position;

a snap action bimetal member mounted in thermal communication with an oven cavity wall, said bimetal member being operatively coupled to said locking pin to move said locking pin to its locked position when the temperature in the cavity exceeds a predetermined locking temperature greater than the normal cooking temperature and less than the normal self-cleaning temperature range and to its unlocked position otherwise;

said locking pin being operative in its locked position to block the return path of said latching tail from its closed position, thereby holding said latch in its closed position, whereby said latch arrangement prevents the opening of the latch when the temperature is above the normal cooking range.

2. The improvement of claim 1 further comprising lock switch means electrically connected in parallel with the thermal limit switch, said lock switch means being operative when actuated to shunt said limit switch, thereby enabling the oven temperature to reach the self-clean range when the lock switch is actuated.

3. The improvement of claim 2 further comprising an indicator light and wherein said lock switch means is further operative when actuated to enable energization of said indicator light to signify to the user that the latch is locked.

4. In a domestic self-cleaning oven having a heated oven cavity, an access door for closing and sealing the cavity, and heating means arranged for connection to an energy source for heating the cavity, said heating means controlled by a user adjustable thermostat for normal cooking operations between about 150° F. and 550° F. and for heat cleaning operation at greater than 750° F. for removing food soils from the cavity walls and a thermal limit switch operative to prevent the temperature from substantially exceeding said normal cooking range, and a door latching mechanism comprising a latching bolt having a hook portion on the free end thereof, the door including a keeper for mating engagement with the hook portion of the latching bolt, and a pivotally mounted handle lever pivotally connected to the latching bolt so that swing action of the handle lever from its open to its closed position causes a swinging movement in the bolt into mating engagement with the keeper, the improvement comprising:

a latch tail rigidly coupled to said latching handle for swinging movement in concert therewith;

a latch switch actuated by said latch tail when said handle is in its closed position, said latch switch being operative when actuated to enable energization of the heating means for operation in the self-cleaning mode;

a locking pin movable between a locked position and an unlocked position;

a snap action bimetal member mounted in thermal communication with an oven cavity wall, said bimetal member being operatively coupled to said locking pin to move said locking pin to its locked position when the temperature in the cavity exceeds a predetermined locking temperature greater than the normal cooking temperature and less than the normal self-cleaning temperature range and to its unlocked position otherwise;

said locking pin being operative in its locked position to block the return path of said latching tail from its closed position, thereby holding said latch in its closed position; and fail safe means responsive to said locking pin operative to prevent the temperature in the cavity from rising to the self-cleaning temperature range unless said locking pin is in its locked position.

5. The improvement of claim 1 wherein said failsafe means comprises lock switch means mounted for actuation by movement of said locking pin to its locked position and having contacts electrically connected in parallel with the thermal limit switch, said lock switch means being operative when actuated to shunt the limit switch, thereby enabling the oven temperature to reach the self-clean range when the lock switch is actuated.

6. The improvement of claim 5 further comprising an indicator light and wherein said lock switch means is further operative when actuated to enable energization of said indicator light to signify to the user that the latch is locked.

7. In a domestic self-cleaning oven having a heated oven cavity for closing and sealing the cavity, and heating means arranged for connection to an energy source for heating the cavity, controlled by a user adjustable thermostat for normal cooking operations between about 150° F. and 550° F. and for self-cleaning operation at greater than 750° F. and a thermal limit switch operative to prevent the temperature from substantially exceeding said normal cooking range, and a door latching mechanism comprising a latching bolt having a hook portion on the free end thereof, the door including a keeper for mating engagement with the hook portion of the latching bolt, and a pivotally mounted handle lever pivotally connected to the latching bolt so that swing action of the handle lever from its open to its closed position causes a swinging movement in the bolt into mating engagement with the keeper, the improvement comprising:

a latch tail rigidly coupled to said latching handle for swinging movement in concert therewith;

a latch switch actuated by said latch tail when the handle is in its closed position, said latch switch being operative when actuated to enable energization of the heating means for self-cleaning operation;

lock switch means operative when actuated to shunt the thermal limit switch thereby enabling the temperature in the cavity to reach the self-cleaning temperature range;

a locking pin movable between a locked position and an unlocked position;

a snap action bimetal member mounted in thermal communication with the oven cavity wall responsive to the temperature thereof, said bimetal being operatively coupled to said locking pin to move said locking pin to its locked position when the temperature in the cavity exceeds a predetermined locking temperature greater than the normal cooking temperature range and less than the normal self-cleaning temperature and to its unlocked position otherwise;

said locking pin being operative in its locked position to block the return path of said latching tail from its closed to its open position, and actuate said lock switch, thereby holding said latch in its closed position, whereby said latch arrangement prevents the opening of the latch when the temperature is above the normal cooking range, and enables the oven to achieve self-cleaning temperature only when the door is locked.

8. The improvement of claim 7 further comprising an indicator light and wherein said lock switch is further operative when actuated to enable energization of said indicator light to signify to the user that the latch is locked.

* * * * *